United States Patent [19]

Colvin et al.

[11] 4,382,242

[45] May 3, 1983

[54] SOLENOID OPERATED ELECTRICAL SWITCH

[75] Inventors: Jack A. Colvin; John V. Hellmann; Alan L. Smock, all of Anderson, Ind.

[73] Assignee: General Motors Corporation, Detroit, Mich.

[21] Appl. No.: 332,473

[22] Filed: Dec. 21, 1981

[51] Int. Cl.[3] ..... H01H 45/04

[52] U.S. Cl. ..... 335/202; 335/131; 335/255

[58] Field of Search ..... 335/131, 202, 255, 278

[56] References Cited

U.S. PATENT DOCUMENTS 3,822,469 7/1974 Lazenby ..... 335/255

OTHER PUBLICATIONS

Service Bulletin IM-100, Published by the Delco Remy Division of General Motors Corp., p. 3.

*Primary Examiner*—Harold Broome

*Attorney, Agent, or Firm*—C. R. Meland

[57] ABSTRACT

A solenoid operated switch that has a cover formed of insulating material secured to the end of a metallic solenoid housing. A pair of internally threaded mounting studs fixed to the solenoid housing extend through openings in the cover and receive threaded screws. The screws have heads engaging the cover and are tightened against the ends of the mounting studs. A rubber coated spring steel gasket is located between the cover and solenoid housing which is flexed from a straight configuration to a bowed configuration when the screws are fully tightened.

3 Claims, 4 Drawing Figures

SOLENOID OPERATED ELECTRICAL SWITCH

This invention relates to solenoid operated electrical switches and more particularly to solenoid operated switches for use on internal combustion engine electrical starters.

Electric cranking motor or starters for cranking internal combustion engines that utilize a shift lever to move the starter pinion into mesh with the ring gear of an engine are fitted with a solenoid operated switch that controls energization of the cranking motor. The plunger of the solenoid operates the switch and is also mechanically connected to linkage which shifts the pinion into and out of mesh with the ring gear.

In solenoid devices of the type that has been described a solenoid housing is provided which is formed of a magnetic material such as steel and a cup-shaped cover formed of electrical insulating material is secured to the end of the solenoid housing. The cover and the end of the solenoid housing form a chamber that contains the switch contacts and the cover supports the fixed contacts of the switch as well as electrical terminals that are connectable to wires or cables. The cover can be attached to the solenoid housing by cap screws which clamp the insulator cover between heads of the screws and a compressible gasket which is interposed between the cover and solenoid housing.

One problem encountered with the method that has been described for attaching the insulator cover to the solenoid housing is the fact that the insulating material of the cover, which may be for example a phenolic material, may shrink during use. If shrinking occurs, the cover is no longer tightly clamped between the screws and the gasket with the result that the screws may loosen and back-out with engine vibration with the result that the cover is no longer properly secured to the solenoid housing.

As a possible solution to this problem it has been proposed to tighten or torque down the heads of the cap screws against the ends of internally threaded metal mounting studs that extend axially of the solenoid housing and through openings in the insulator cover. The heads of the screws engage both the insulator cover and the ends of the studs and the screws are tightened or torqued down so they tightly engage the ends of the metal studs. In this arrangement a thin gasket, formed of rubber coated steel was placed between the cover and the solenoid housing and this gasket was compressed when the screws were fully torqued down against the ends of the studs to provide a seal between the cover and solenoid housing. In this arrangement the relatively thin gasket can compress only slightly when the screws are tightened with the result that the insulator cover may be over-compressed in an axial direction and hence over-stressed which may result in fracture of the cover if subjected to an impact. This depends on the axial stack-up of parts and where, in effect, the cover is too long for the dimension between the heads of the tightened screws and the compressed gasket and an overstress may occur.

In contrast to the method of attaching the cover to the solenoid housing that has just been described it is an object of this invention to provide a method of attaching the cover to the end of the solenoid housing wherein a spring-metal gasket is provided that is located between the insulator cover and solenoid housing and arranged to bow or deflect when the cover screws are tightened into engagement with the ends of the mounting studs. In carrying this object forward a flat, thin rubber coated spring steel gasket is provided which, prior to the torqueing down or tightening of the screws, is in a flat condition and is placed between the insulator cover and the end of the solenoid housing. As the screws are torqued down against the ends of the metal mounting studs the gasket flexes or bows and the spring metal of the spring steel portion of the gasket provides a spring force to maintain the cover clamped between the flexed gasket and the heads of the screws to provide a cushioned mounting for the insulator cover. Thus, any axial variation in the stack-up of parts will be accommodated by spring deflection of the gasket which permits the cover member to be axially clamped but not overstressed. Thus, as the screws are torqued down tightly against the ends of the metal studs the gasket deflects to accommodate axial movement of the cover.

IN THE DRAWINGS

Figure 1:
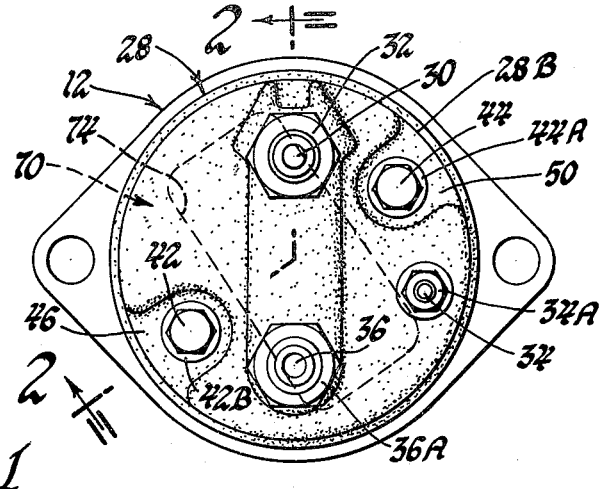
FIG. 1 is an end view of a solenoid operated switch made in accordance with this invention.
Figure 2:
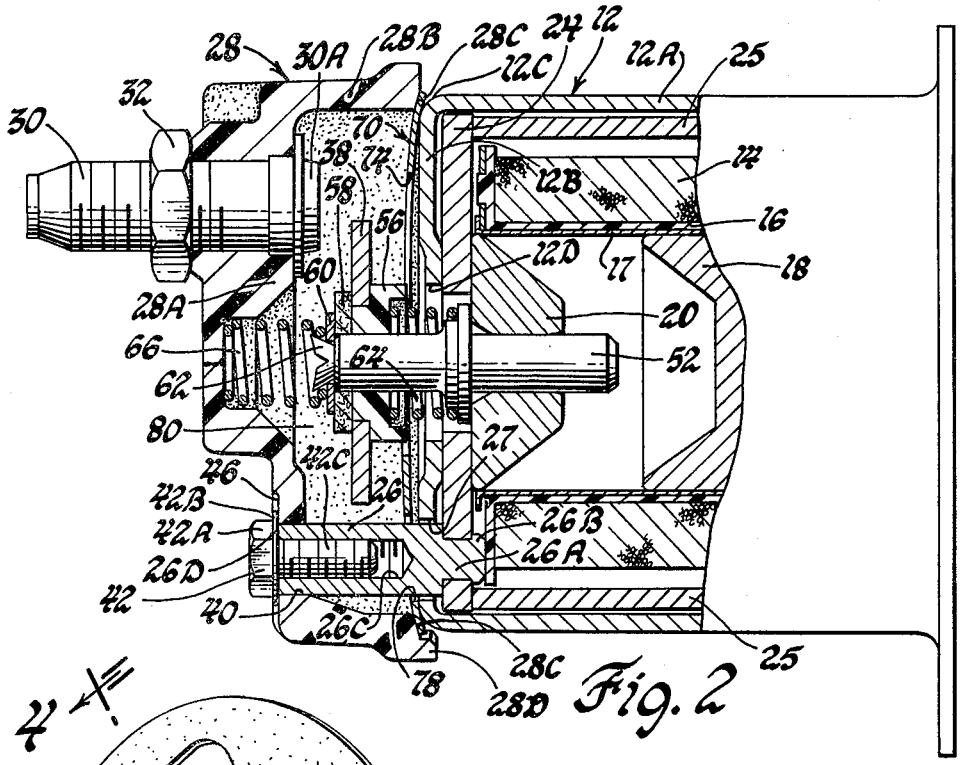
FIG. 2 is a view on an enlarged scale partly in section taken along line 2—2 of FIG. 1.

Referring now to the drawings and more particularly to FIGS. 1 and 2, a solenoid operated switch made in accordance with this invention is illustrated. The solenoid is a component of an electric starter and has a housing or case generally designated by reference numeral 12 which is formed of a magnetic material such as steel. The housing 12 has a tubular portion 12A, an integral end wall 12B and an annular curved edge portion 12C. The end wall 12B has a central circular opening designated by reference numeral 12D.

The steel housing 12 contains a solenoid coil winding designated by reference numeral 14 which includes the usual pull-in coil and a hold-in coil as is known to those skilled in the art. These coil windings are supported by a coil support formed of insulating material and designated by reference numeral 16 which is disposed about tubular steel part 17. The solenoid has a conventional steel plunger 18 which is reciprocable within the tubular part 17 in a conventional fashion. This plunger, as is known to those skilled in the art, is connected to linkage that shifts the electric starter pinion. The solenoid further has a fixed stop 20 formed of steel and has a steel plate 24 which abuts one side of the end wall 12B of the housing 12 and annular end wall of tubular steel part 25. The plate 24 supports a circular metal mounting stud 26, preferably formed of steel, which has a portion 26A extending through an opening in the plate 24 which is headed over at 26B to secure the stud to the plate. The stud 26 has an internally threaded bore 26C and an annular flat end wall 26D. The stud 26 extends through an opening 27 formed in end wall 12B. Although FIG. 2 illustrates only one stud 26 another stud (not illustrated) is provided which is identical to the stud 26 which is attached to plate 24 in the same manner as stud 26 and which passes through another opening in the end wall 12B of the solenoid housing.

The solenoid assembly includes a cover or cap generally designated by reference numeral 28 which is formed of an electrical insulating material such as a thermosetting phenolic material. The cover 28 is generally cup-shaped having an end wall 28A and an annular axially extending wall 28B. The cap has an annular slanted surface 28C which may be, for example approximately 15° to a plane extending transverse the cap and normal to its axis. The wall 28C therefore is an annular slanted wall which defines a generally conical surface extending the entire circumference of the cover. The cap further has three equally spaced axially projecting portions 28D one of which is illustrated in FIG. 2. These projecting portions extend for a short arcuate amount and can be used as an aid to assembly.

The insulating cover 28 supports a terminal stud 30 extending through an opening in the cover 28 and fixed in place by a nut 32 engaging an externally threaded portion of the terminal 30. The cover 28 further supports a solenoid terminal stud 34 and another terminal stud 36 that extend through openings in the cover in a conventional fashion. The terminal studs 34 and 36 are externally threaded to receive retaining nuts 34A and 36A. The terminal stud 30 has an electrical contact portion 30A which is adapted to engage an annular shiftable electrical contact disk 38. Further, the terminal stud 36 is provided with a contact portion aligned with contact portion 30A (not illustrated) which is engaged, at times, by the contactor 38 when it engages contact 30A to thereby electrically connect the terminal studs 30 and 36.

The cap 28 has a pair of circular openings one of which is designated by reference numeral 40. The opening 40 receives the end of the stud 26 when the cover is assembled to the solenoid housing. The cover 28 is secured to the solenoid housing 12 by cap screws 42 and 44. These screws are identical and only one of them will therefore be described in detail. The screw 42 has a hexagonal head 42A and an integral annular head portion 42B. It can be seen in FIG. 2 that the threaded portion 42C of the cap screw 42 is threaded to the threaded bore 26C of the stud 26. When the screw 42 is fully torqued down one wall of the annular portion 42B of the screw engages the end wall of the stud 26 and also engages a flat surface 46 formed in the cap 28. The same type of attaching arrangement is provided utilizing cap screw 44 shown in FIG. 1. That is, the annular portion 44A of the cap screw 44 engages a flat surface 50 formed on the cap 28 and the annular portion 44A engages the end wall of another stud identical to stud 26 (not illustrated) which is supported by the plate 24 in the same manner as the connection of stud 26 to plate 24. This other stud also has an internally threaded bore to which the cap screw 44 is threaded and the stud passes through an opening in cap 28. The end of the other stud and the end 26D of stud 26 are located at the same distance from plate 24.

The movable contact assembly comprises a metallic shiftable plunger 52 slidable in an opening formed in stop 20 which at times is engaged and then moved by the solenoid plunger 18 when the plunger 18 is attracted to the left in FIG. 2. The plunger 52 supports the movable contact disk 38 via insulators 56 and 58 and a metal washer 60 which engages a bent over portion 62 of plunger 52. The insulator 56 is slidably supported on plunger 52 and a spring 64 is interposed between a portion of the plunger 52 and insulator 56. Another spring 66 disposed between the cover 28 and washer 60 opposes movement of the plunger to the left in FIG. 2 to thereby bias the movable contact parts to the FIG. 2 position and in a direction to move contact 38 away from the fixed contacts. The spring 64 compresses to permit some movement of the plunger 52 relative to contact 38 when the contact 38 engages the fixed contacts to assure good contact pressure between contact 38 and the fixed contacts.

Figure 3:
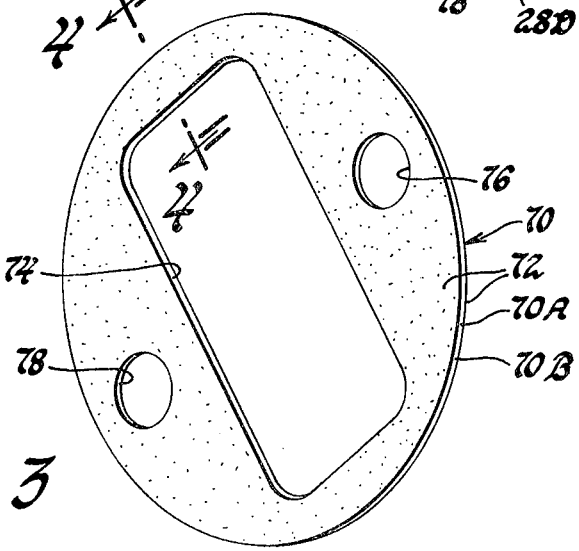
FIG. 3 is a perspective view of a gasket that is utilized in this invention.
Figure 4:
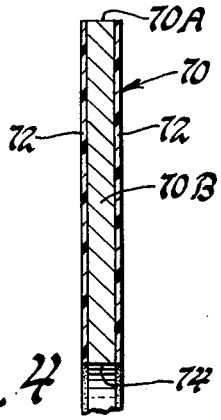
FIG. 4 is a sectional view taken along line 4—4 of FIG. 3.

FIGS. 3 and 4 illustrate a gasket which is a component of the solenoid assembly. This gasket is generally designated by reference numeral 70 and, as shown in FIG. 3, has an outer cylindrical edge 70A. The gasket is comprised of a thin spring steel plate 70B which is coated on both sides by an elastomeric material such as rubber and designated by reference numeral 72. The spring steel plate 70B may be approximately 0.015 inches thick and the rubber coating 72 approximately 0.002 inches thick. The spring steel material of the plate can be deflected or bowed and will spring back to its normal straight planar configuration illustrated in FIG. 3. The gasket 70 has a central rectangular opening designated by reference numeral 74 which accommodates electrical connections and the shiftable parts of the solenoid switch. The gasket further has circular openings 76 and 78 which respectively receive the studs, like stud 26 illustrated in FIG. 2. The openings have a slightly larger diameter than the studs.

When the cover 28 is to be assembled to the solenoid case 12 the gasket 70 is assembled to the end 12B of the solenoid housing with the stud 26 and the other stud that has not been illustrated, like the stud 26, passing through the openings 76 and 78 of the gasket 70. The cover 28 is now placed in a position in which the mounting studs project into the openings in the cover 28. With the gasket in its flat, straight condition between the cover 28 and solenoid housing wall 12B the screws 42 and 44 are threaded to the mounting studs and are torqued or tightened down against the ends of the mounting studs. As the screws are torqued down or tightened, the gasket deflects from its straight condition to substantially the deflected or bowed condition illustrated in FIG. 2. This is accomplished by the conical surface 28C of the cover member engaging an annular marginal edge of the gasket to deflect or bow it as shown. As screws 42 and 44 are tightened they move the cover 28 toward the solenoid housing 12 and the gasket will deflect until the annular portions 42B and 44A of the screws bottom out on the ends of the mounting studs. The gasket 70 therefore permits cushioned axial movement of the cover 28 as the screws are tightened without danger of applying excess axial pressure to the cover when the screws are fully bottomed out on the ends of the mounting studs. The elastomeric coating 72, on each side of the gasket, engages respectively the conical wall 28C of cover 28 and an annular wall portion of the end wall 12B of the solenoid housing 12 to thereby seal the chamber 80 containing the switch contacts. The edge 12C of housing 12 is curved to permit deflection of the outer marginal portion of the gasket 70 toward housing 12. The outer diameter of the gasket 70 is slightly larger than the outer diameter of solenoid housing portion 12A.

In regard to the flexing or bowing of gasket 70, the gasket is bowed to a configuration (FIG. 2) that is generally concave on the side facing solenoid housing 12 and generally convex on the side facing cover 28 when screws 42 and 44 are fully tightened against the ends of the mounting studs. Thus, as screws 42 and 44 are tightened the gasket 70 is forced into engagement with wall 12B and as the screws are fully tightened the gasket is bowed or deflected by circumferentially extending conical surface 28C. During this deflection an annular portion of wall 12B adjacent edge 12C, which contacts an annular portion of gasket 70, acts as a fulcrum for the bowing action. The portion of the gasket not engaged by conical wall 28C deflects toward cover 28 but the deflection is not so great as to interfere with contact 38. The screws are tightened against the ends of the studs with sufficient torque to tightly engage the ends of the studs to thereby prevent the screws from backing-out during use.

As mentioned, the solenoid that has been described is a component of a conventional electric starter for cranking an internal combustion engine. When assembled to a starter or cranking motor the right end of plunger 18 (not illustrated) is mechanically connected to a shift lever which in turn shifts the pinion of the starter drive. The plunger 18 is spring biased to the position shown in FIG. 2 by a conventional return spring (not illustrated) which is compressed when plunger 18 is attracted toward stop 20 by energization of coil winding 14. When coil winding 14 is deenergized the return spring shifts the plunger 18 to the FIG. 2 position.

The tubular steel part 25 provides a magnetic flux path between plate 24 and plunger 18 in a manner well known to those skilled in the art.

The embodiments of the invention in which an exclusive property or privilege is claimed are defined as follows:

1. A solenoid operated electrical switch comprising, a solenoid housing formed of metallic magnetic material having an end wall and a tubular portion extending axially of the end wall in one direction, a plurality of threaded mounting studs extending axially of said end wall located at the exterior of said solenoid housing, a generally cup-shaped insulator cover formed of electrical insulating material having openings receiving said studs and defining a chamber with the end wall of said solenoid housing, fastener means threaded to said studs each having head means engaging an end portion of a stud and a flat portion of said insulator cover when the fastener means are tightened to a position wherein the head means engages an end portion of a stud, a thin gasket formed of spring metal material carrying an outer layer of elastomeric material on both sides thereof interposed between the end wall of the solenoid housing and said insulator cover and sandwiched between the same in a substantially circular configuration, the gasket having an initial flat configuration, the insulator cover having an outer circumferentially extending generally conical surface inclined toward the longitudinal axis of the cover engaging an outer annular marginal portion of the gasket, the solenoid housing engaging the gasket, the insulator cover, studs and fastener means being so arranged that said gasket is flexed from its initial flat configuration to a bowed configuration when said fastener means is tightened to engage said head means with an end portion of a stud, said bowed gasket providing an axial spring force to resiliently clamp said insulator cover between said marginal portion of the gasket and said fastener head means and sealing engagement between the gasket and solenoid housing and between the gasket and insulator cover, and switching means disposed within said chamber.

2. A solenoid operated electrical switch comprising, a solenoid housing formed of metallic magnetic material having an end wall and a tubular portion extending axially of the end wall in one direction, a plurality of internally threaded mounting studs supported by said solenoid housing extending axially of said end wall in an opposite direction, a generally cup-shaped insulator cover formed of electrical insulating material having openings receiving said studs and defining a chamber with the end wall of said solenoid housing, externally threaded fastener means threaded to said studs each having head means engaging an end portion of a stud and a flat portion of said insulator cover when the fastener means are tightened to a position wherein the head means engages an end portion of a stud, a thin gasket formed of spring metal material carrying an outer layer of elastomeric material on both sides thereof interposed between the end wall of the solenoid housing and said insulator cover, the gasket having an initial flat configuration, the insulator cover having an outer circumferentially extending generally conical surface inclined toward the longitudinal axis of the cover engaging an outer annular marginal portion of the gasket, the solenoid housing engaging the gasket, the insulator cover, studs and fastener means being so arranged that said gasket is flexed with its initial flat configuration to a bowed configuration when said fastener means is tightened to engage said head means with an end portion of a stud, the bowed gasket having a generally concave side facing the solenoid housing and a generally convex side facing the cover, said bowed gasket providing an axial spring force to resiliently clamp said insulator cover between said marginal portion of the gasket and said fastener head means and sealing engagement between the gasket and solenoid housing and between the gasket and insulator cover, and switching means disposed within said chamber.

3. A solenoid operated electrical switch comprising, a solenoid housing formed of metallic magnetic material having an end wall and a tubular portion extending axially of the end wall in one direction, said housing having an annular curved edge joining said walls, a plurality of threaded mounting studs extending axially of said end wall located at the exterior of said solenoid housing, a generally cup-shaped insulator cover formed of electrical insulating material having openings receiving said studs and defining a chamber with the end wall of said solenoid housing, fastener means threaded to said studs each having head means engaging an end portion of a stud and a flat portion of said insulator cover when the fastener means are tightened to a position wherein the head means engages an end portion of a stud, a thin gasket formed of spring metal material carrying an outer layer of elastomeric material on both sides thereof interposed between the end wall of the solenoid housing and said insulator cover, the gasket having an initial flat configuration, the insulator cover having an outer circumferentially extending generally conical surface inclined toward the longitudinal axis of the cover engaging an outer annular marginal portion of the gasket, the solenoid housing engaging the gasket, the insulator cover, studs and fastener means being so arranged that said gasket is flexed from its initial flat configuration to a bowed configuration when said fastener means is tightened to engage said head means with an end portion of a stud, said generally conical surface forcing said annular marginal portion of said gasket toward said annular curved edge of said solenoid housing, said bowed gasket providing an axial spring force to resiliently clamp said insulator cover between said marginal portion of the gasket and said fastener head means and sealing engagement between the gasket and solenoid housing and between the gasket and insulator cover, and switching means disposed within said chamber.

* * * * *